United States Patent [19]

Shibuya

[11] Patent Number: 4,920,728

[45] Date of Patent: May 1, 1990

[54] METHOD FOR PACKING CIGARETTES

[76] Inventor: Kiyotake Shibuya, No. 2-6-10, Omori-Minami, Ota-ku, Tokyo-to, 143, Japan

[21] Appl. No.: 318,214

[22] Filed: Mar. 2, 1989

[51] Int. Cl.[5] ..... B65B 61/20; A24F 15/00

[52] U.S. Cl. ..... 53/410; 53/474; 206/265; 229/87.13

[58] Field of Search ..... 53/410, 474; 206/265, 206/266, 267, 268, 269, 270, 271; 229/87 C

[56] References Cited

U.S. PATENT DOCUMENTS

| | | | |
|---|---|---|---|
| 1,943,204 | 1/1934 | Chute | 206/265 |
| 1,965,049 | 7/1934 | Nahm | 206/267 X |
| 1,967,204 | 7/1934 | Genz | 206/267 X |
| 2,202,281 | 5/1940 | Wilson | 206/267 X |
| 2,378,774 | 6/1945 | Husted | 206/270 X |
| 2,404,312 | 7/1946 | Reynolds | 206/268 |
| 2,475,896 | 7/1949 | Husted | 206/270 X |
| 2,861,733 | 11/1958 | Metzger | 229/8 T |
| 2,901,097 | 8/1959 | Tamarin | 206/267 |
| 3,021,992 | 2/1962 | Phillips, Jr. | 206/267 |

*Primary Examiner*—Robert L. Spruill
*Assistant Examiner*—Beth Bianca
*Attorney, Agent, or Firm*—Scrivener and Clarke

[57] ABSTRACT

A thin sheet with a suitable degree of flexibility is interposed between tips of cigarettes to be packed in a package and the inner surface of a top of the package so that when the upper portion of the package is opened to define a cigarette picking up opening, the thin sheet remains in said opening in the form of an inner cover or lid.

3 Claims, 1 Drawing Sheet

METHOD FOR PACKING CIGARETTES

BACKGROUND OF THE INVENTION

The present invention relates to a method for packing cigarettes so as to retain the quality of cigarettes even after a package for the cigarettes is opened.

With conventional packing of cigarettes, as shown in FIG. 1 a predetermined number of cigarettes 1 are wrapped with a sheet of inner packing paper 2 for water- and humidity-proofness and with a sheet of outer paper 3 for correct information on the packed cigarettes 1 and for enhancement of their commercial value. Further, the outer packing paper 3 is wrapped with a transparent sheet of packing paper 4.

When a package of cigarettes packed in the above-described conventional packing manner is opened, an opening is defined through the packaging sheets 2, 3 and 4 on the side of tips 1*a* of the cigarettes 1 so that the interior of the package is communicated with the surrounding atmosphere. As a result, aroma inherent to the packed cigarettes tends to be lost; cigarettes dust particles are scattered to surrounding atmosphere; and the package is deformed.

In view of the above, an object of the present invention is to prevent escaping of aroma of cigarettes, scattering of tobacco leaf dust particles and distortion of the package after it has been opened, thereby retaining the original quality of cigarettes as long as possible.

The above and other objects of the present invention will become more apparent from the following description of a preferred embodiment thereof taken in conjunction with the accompanying drawing.

DETAILED DESCRIPTION OF THE PREFERRED EMBODIMENT

Figure 1:
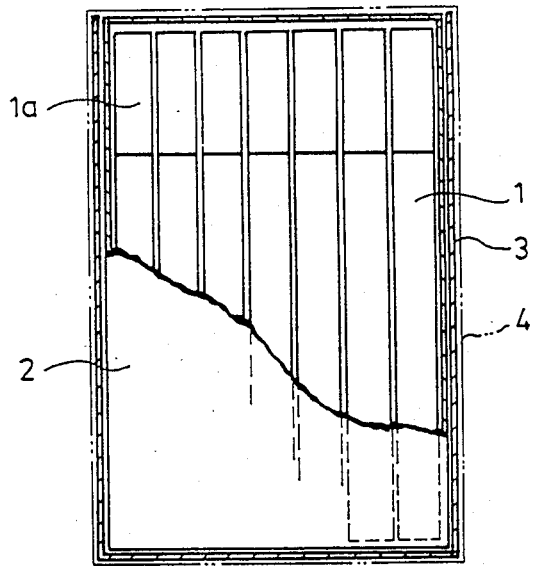
Fig. 1 PRIOR ART
FIG. 1 is a side view with a part cut away illustrating the cigarettes packed in a conventional manner.
Figure 2:
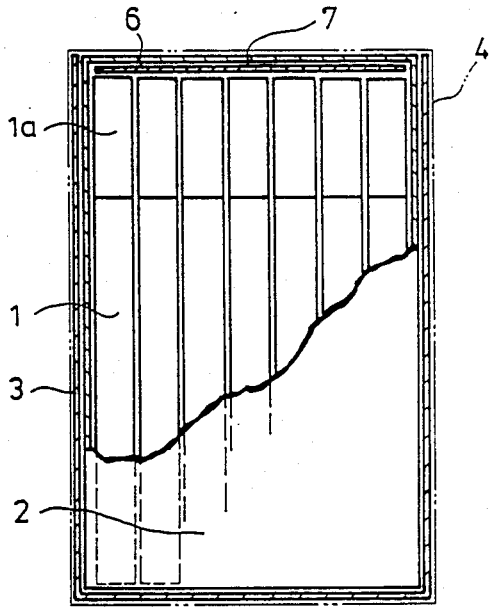
FIG. 2 is a side view with a part cut away of a package of cigarettes packed by a method in accordance with the present invention.
Figure 3:
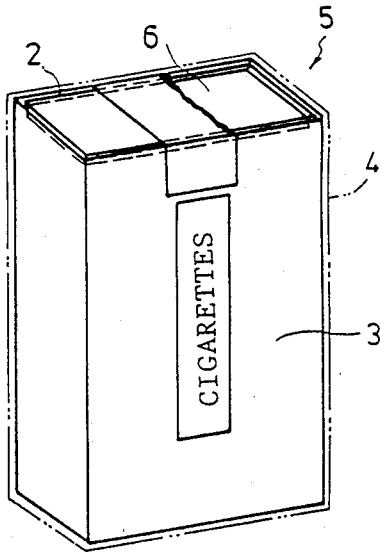
FIG. 3 is a perspective view thereof.

Referring now to FIGS. 2 and 3, in a method for packing cigarettes wherein a predetermined number of cigarettes are first packed with an inner sheet of packing paper, the inner package thus produced being further wrapped with an outer sheet of hard packing paper 3 except the top of the inner package 2, the top of the inner package and the outer surfaces of the outer packing being further wrapped with a sheet of transparent paper, and when the cigarettes 1 are packed with the inner sheet of packing paper 2, a thin sheet 6 which has a predetermined degree of rigidity and a predetermined degree of flexibility and which is slightly smaller in size than the inner package is disposed between the tips 1*a* of the cigarettes 1 and that portion of the package through which each packed cigarette 1 is removed after the package of the cigarettes 1 is opened. A paste or adhesive may be applied to the center portion of the thin sheet 6 to securely bond the same at 7 to the undersurface of the top of the inner package 2.

After the package of cigarettes 1 is opened to define a cigarette removal opening 5, there exists the thin sheet 6 having a predetermined degree of flexibility and a predetermined degree of rigidity as an inner cover so that the escape of aroma inherent to the cigarettes 1 into the surrounding atmosphere, the scattering of tobacco leaf dust particles into the surrounding atmosphere and the contact of the tips 1*a* of the cigarettes 1 with external unsanitary objects can be prevented. Furthermore, because of rigidity of the sheet 6, the deformation of the package of the cigarettes 1 can be prevented. When a smoker prepares to remove a cigarette 1 from the package, he/she can first bend up by his/her finger the sheet 6 existing as an inner cover so that he/she can then easily remove a cigarette 1 from the package. Thereafter, when his/her finger is released from the bent sheet 6, the latter returns to its initial position due to its predetermined degree of flexibility, thereby closing the opening 5.

It is to be understood that the method for packing cigarettes in accordance with the present invention is not limited to the above-described embodiment and that various modifications may be effected without departing from the true spirit of the present invention. For instance, a further sheet may be interposed between the leading ends of the cigarettes 1 and the inner surface of the bottom portion of the inner package 2, whereby the distortions of the package of cigarettes can be further positively prevented.

As described above, according to the present invention, the thin sheet having a predetermined degree of rigidity and a predetermined degree of flexibility is interposed between the array of tips of cigarettes and the inner surface of the top of the inner package so that when a cigarette removal opening is formed at the top of the package, the following various effects can be attained.

(I) The thin sheet remains in the package as an inner lid or cover closing the cigarette removal opening so that the escape of aroma inherent to the cigarettes and the spreading of tobacco leaf dust particles in the surrounding atmosphere can be prevented.

(II) Since the thin sheet has a suitable degree of rigidity, the deformations of the packages of cigarettes can be prevented.

(III) Since the thin sheet has a suitable degree of flexibility, a smoker picks up a cigarette from the package while the thin sheet can be bent up by his/her finger at the cigarette removal opening, so that he/she can easily pick up a cigarette from the package. Then the thin sheet is released from his/her finger and returns to its original flat position, thereby closing the cigarette picking up opening.

(IV) Because of the above-described effects, the original quality of packed cigarettes can be maintained even after the top of a package of cigarettes is opened and furthermore the packed cigarette can be maintained under sanitary condition.

What is claimed is:

1. A method for packing cigarettes which comprises interposing a flat flexible thin sheet between an upper portion of a package of cigarettes to be opened to define a cigarette removal opening and tips of cigarettes packed in the package, raising up said flexible sheet after said package is opened to permit removal of a cigarette through said opening, and then closing off said opening by releasing said flexible sheet whereby said thin flexible sheet returns to its original position due to its natural resiliency.

2. The method according to claim 1 wherein said thin sheet is bonded at its center portion to an inner surface of the top of said package.

3. The method according to claim 1 wherein said thin sheet has a length substantially equal to the width of the package whereby said sheet is interposed between said upper portion of said package and all of the tips of cigarettes originally packed in said package.

* * * * *